United States Patent [19]

Van Duyne

[11] Patent Number: 4,972,752

[45] Date of Patent: Nov. 27, 1990

[54] MICROTONAL KEY MODULE AND SYSTEM

[76] Inventor: Scott A. Van Duyne, 16 Indiana Ave., Somerville, Mass. 02145

[21] Appl. No.: 326,603

[22] Filed: Mar. 21, 1989

Related U.S. Application Data

[63] Continuation of Ser. No. 10,307, Feb. 3, 1987, abandoned.

[51] Int. Cl.[5] ..... G10C 3/12

[52] U.S. Cl. ..... 84/423 R; 84/451

[58] Field of Search ..... 84/423 R, 423 B, 451, 84/424, 428, 626–633, 644, 658, 670, 687–690, 743–746, DIG. 7; D17/1

[56] References Cited

U.S. PATENT DOCUMENTS

| | | | |
|---|---|---|---|
| 1,571,431 | 2/1926 | Pitt-Taylor | 84/423 B X |
| 2,049,564 | 8/1936 | Hintermeyer | 84/423 B X |
| 2,061,364 | 11/1936 | Luedtke | 84/423 B X |
| 2,142,580 | 1/1939 | Williams | 84/423 B X |
| 3,012,460 | 12/1961 | Wilson | 84/423 B X |
| 3,067,645 | 12/1962 | Moschino | 84/423 B X |
| 3,342,094 | 9/1967 | Wilson | 84/423 B X |
| 3,468,209 | 9/1969 | Barretto | 84/423 B X |
| 3,916,754 | 11/1975 | Thiel | 84/423 B X |
| 3,922,944 | 12/1975 | Kurosaki et al. | 84/423 R X |
| 4,031,800 | 6/1977 | Thompson | 84/423 B X |
| 4,655,117 | 4/1987 | Roose | 84/423 B |

FOREIGN PATENT DOCUMENTS

| | | | |
|---|---|---|---|
| 2376480 | 9/1978 | France | 84/423 B |
| 0294723 | 11/1953 | Switzerland | 84/423 B |

*Primary Examiner*—Stanley J. Witkowski

*Attorney, Agent, or Firm*—Joseph S. Iandiorio; Brian M. Dingman

[57] ABSTRACT

A microtonal key module includes a central key and a number of surrounding keys clustered about the central key. The central key and the surrounding keys establish among each other a progression of successive microtonal increments. A plurality of such microtonal key modules are arranged to form a microtonal keyboard system.

21 Claims, 4 Drawing Sheets

MICROTONAL KEY MODULE AND SYSTEM

This application is a continuation of application Ser. No. 010,307, filed Feb. 3, 1987 and now abandoned.

FIELD OF INVENTION

This invention relates to one or more modules of keys for a keyboard instrument, and more particularly to such a key module having a central key entirely surrounded by other keys which establish among each other a progression of microtonal increments.

BACKGROUND OF INVENTION

There is increasing interest in microtonal music, but presently there are no instruments designed to accurately and repeatably play a variety of microtonal music. The term microtonal music refers to scales having pitches different from the standard twelve half-tones per octave. Most conventional instruments, including the piano, are designed to generate twelve equal-tempered half-tones per octave, there being seven diatonic tones and five intermediate tones which are represented by accidentals.

Microtonal music typically involves equal-tempered microtonal increments of quarter-tones, sixth-tones, or twelve-tones which generate twenty-four, thirty-six and seventy-two different pitches, respectively, per octave. Microtonal music is presently played on many orchestral and band instruments through alternative fingerings, innovative lip positions, or other techniques specific to the individual instrument. However, a great deal of practice and effort is required to accomplish these techniques, and accurate, repeatable renditions of the microtonal music are difficult at best.

While microtonal music may be finessed on many instruments, it is simply not possible to produce microtonal music on conventional keyboards such as the piano unless the actual tuning of each key is altered. Since a piano has only 88 keys, no more than 88 distinct pitches are possible on that instrument.

One keyboard, described in U.S. Pat. No. 3,012,460 granted to Wilson, carries thirty-one keys per octave to produce thirty-one different tones of equal temperament for each octave. However, this keyboard is still based on the arrangement of a conventional piano. For example, the keys are arranged in five rows, the central row containing seven diatonic tones per octave corresponding to the white keys of the piano, and the row above it containing keys corresponding to the five black keys per octave of a conventional piano. This relationship is constraining for the playing of microtonal music having scales other than thirty one tones per octave.

SUMMARY OF INVENTION

It is therefore an object of this invention to provide an improved microtonal keyboard system on which microtonal music can be conveniently played, composed, and studied.

It is a further object of this invention to provide such a keyboard system which can provide logical organization of a vast number of keys.

It is a further object of this invention to provide such a keyboard system which can supply convenient access to both large and small pitch intervals.

It is a further object of this invention to provide such a keyboard system which can supply a convenient layout for four or more octaves in a 72-note scale.

Yet another object of this invention is to provide such a keyboard system which can be reprogrammed to play different microtonal scales.

A still further object of this invention is to provide a microtonal key module which enables accurate and repeatable playing of a progression of successive microtonal increments.

It is a further object of this invention to provide such a key module which is readily interlockable with other modules to form a keyboard.

Yet another object of this invention is to provide such interlocking key modules which are compact and combinable to accurately establish a pitch continuum.

This invention results from the realization that a truly effective keyboard for playing, composing, and studying microtonal music, and which provides freedom from the constraints of conventional piano keyboards, can be achieved by organizing many keys in one or more modules, each module having a central key about which are clustered a number of surrounding keys, and the central key and the surrounding keys establishing among each other a progression of successive microtonal increments.

This invention features a microtonal key module having a central key and a plurality of surrounding keys clustered about the central key, the central key and the surrounding keys establishing among each other a progression of successive microtonal increments.

In one embodiment, the surrounding keys are each substantially equally spaced from the central key. There may be six surrounding keys clustered about the central key, and the module may share at least one of the surrounding keys with an additional and similar microtonal key module which continues the progression.

In an other embodiment, the progression of microtonal increments commences at an initial one of the surrounding keys and proceeds among the surrounding keys and the central key until a final one of the outer keys is reached. The final surrounding key is simultaneously the commencing one of the surrounding keys of a second, successive microtonal key module which continues the progression. Further, the initial commencing surrounding key of the initial module may simultaneously be the final surrounding key of a third microtonal key module. The second and third modules may be disposed in opposing directions about the central key. The successive microtonal increments may be equal-tempered sixth-tones or twelfth-tones.

This invention also features a microtonal keyboard system having a plurality of microtonal key modules. Each module includes a central key and a plurality of surrounding keys clustered about the central key. A progression of successive microtonal increments is established by the keys for each module.

In one embodiment, each module shares at least one of its surrounding keys with at least one other of the modules such that the end of one of the module progressions of microtonal increments coincides with the start of a successive module progression to establish a continuum of the microtonal increments through the modules The central keys are spaced from each other by the same number of tone increments; each central key may be six microtonal increments from the central keys of adjacent modules.

In another embodiment, the modules extend successively in a first direction, and the central keys are disposed in a central column extending in the first direction. Each central key may be one of twelve half-tones of an octave, and may be separated along the central column from the next central key by one of the surrounding keys. The remainder of the surrounding keys define a first column on one side of the central column and a second column on the other side Each microtonal increment may be a twelfth-tone, and the keys of each column establish a quarter-tone scale along that column. The central and surrounding keys are aligned in successive rows extending in a second direction transverse to the first direction to establish successive twelfth tone scales.

In still another embodiment, each of the central and surrounding keys includes switch means for registering actuation of that key by an operator. The switch means may be a touch-sensitive switch manipulatable by the operator.

This invention further features a microtonal keyboard system having a number of microtonal key modules, each module sharing at least one of its surrounding keys with at least one other of the modules. The end of one of the module progressions of microtonal increments coincides with the start of a successive module progression to establish a continuum of the microtonal increments through the modules within each of a number of module groups extending in a first direction. The module groups may be arranged in first and second sets. The module groups of the first set alternate with the module groups of the second set in a second direction transverse to the first direction to establish a preselected relationship between adjacent module groups of the first and second sets. Each key of each module group may differ by one-half of an octave in the second direction from the corresponding key of the adjacent module group.

DISCLOSURE OF PREFERRED EMBODIMENT

Other objects, features and advantages will occur from the following description of a preferred embodiment and the accompanying drawings, in which.

This invention may be accomplished by a keyboard instrument having one or more microtonal key modules each having a central key and a number of surrounding keys clustered about the central key. A progression of successive microtonal increments is established among the keys.

Figure 1:
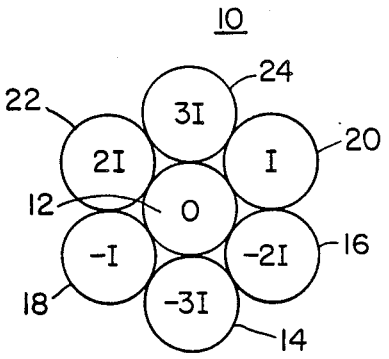
FIG. 1 is a schematic diagram of a microtonal key module according to this invention.

Microtonal key module 10 according to this invention, FIG. 1, includes central key 12 and surrounding keys 14, 16, 18, 20, 22, 24. A progression of microtonal increments I is established through the keys, commencing with surrounding key 14 and ending with final surrounding key 24. The pitch relationship between each surrounding key and central key 12 is represented by designating key 12 as having a pitch of zero, surrounding key 14 as having a pitch of −3I, surrounding key 16 as having a pitch of −2I, with the progression continuing until surrounding key 24 is reached, having a pitch of 3I.

Figure 2:
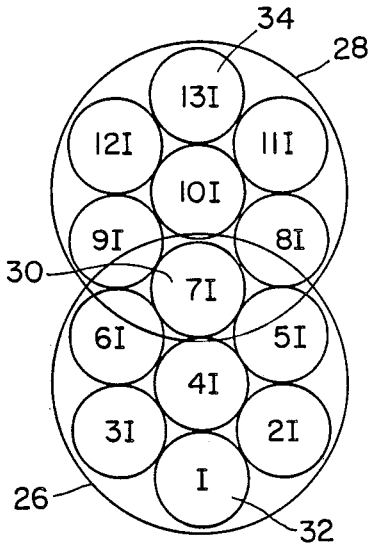
FIG. 2 is a schematic diagram of two interlocking key modules.

Several relationships are established by the arrangement of module 10. All keys having a pitch within 3I of central key 12 are adjacent to it. Further, pitches differing by the same magnitude but with opposing signs are diametrically opposed around the primary tone of central key 12. This arrangement provides a relationship which is logical and easy to learn for an operator of a keyboard instrument utilizing one or more modules according to this invention. Further, two or more modules can be joined together as indicated by modules 26, 28, FIG. 2. Modules 26, 28 are interlocked to share key 30 so that, commencing with key 32 and ending with key 34, a continuum of microtonal pitches progresses successively through modules 26, 28.

Figure 3A:
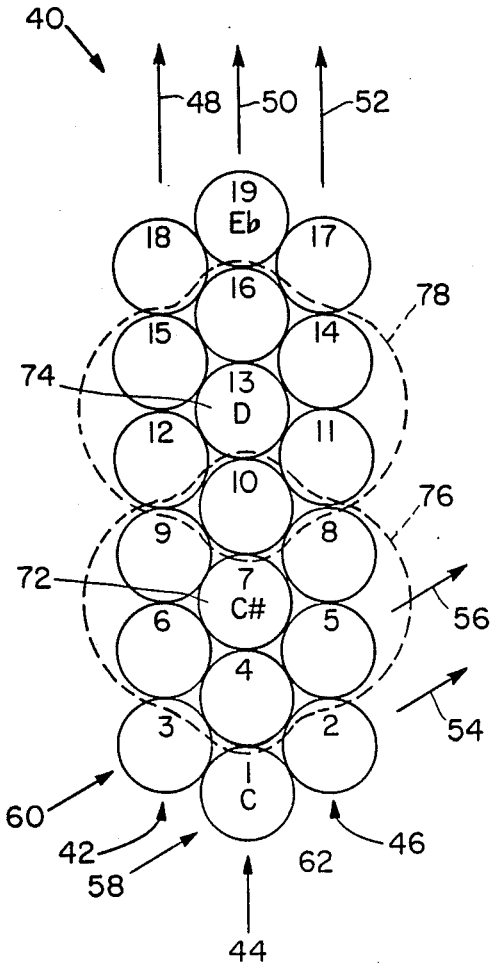
FIG. 3A is a schematic diagram of a portion of a group of modules establishing three columns of keys progressing in quarter-tones and simultaneously establishing a number of rows progressing in twelfth-tones.
Figure 3B:
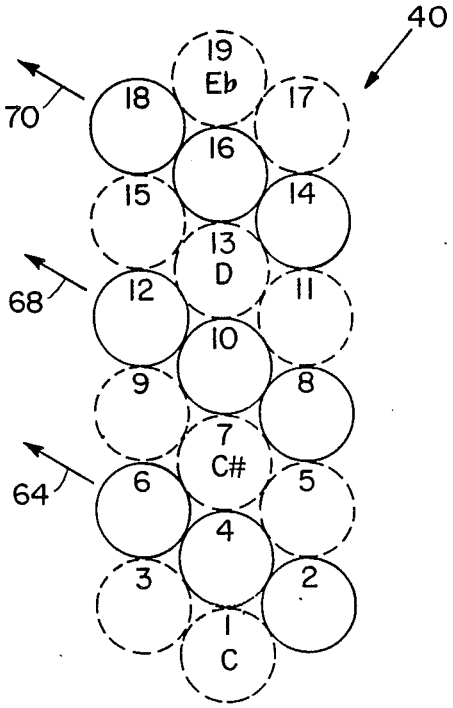
FIG. 3B is a schematic diagram of the group of FIG. 3A showing the progression in a third direction of sixth-tones.

In one construction, the microtonal increment I is a twelfth-tone, that is, there are twelve increments I per whole tone and 72 increments I per octave. Module group 40, FIG. 3A, is formed of a number of keys establishing equal-tempered twelfth-tone increments. The keys are arranged in three columns 42, 44, 46 and establish a progression of quarter-tones in a first direction represented by arrows 48, 50, 52, respectively, for each column. Further, the keys are arranged in successive rows to establish a progression of twelfth-tones in a second direction indicated by arrows 54, 56 for rows 58, 60, respectively. Beginning with key 62, representing the diatonic tone C, the keys are numbered consecutively to represent the progression of twelfth-tones The progression of sixth-tones in a third direction transverse to the other two directions is illustrated in FIG. 3B by arrows 64, 68, 70, respectively. Referring to FIG. 3A, a third-tone scale progresses successively among keys 1, 5, 9, and 13.

Keys 72, 74 represent the central keys of modules 76, 78, respectively. Key 62 is selected as the key with the lowest pitch in this construction, and is not completely surrounded by surrounding keys. Rather than being contiguous as in a conventional piano keyboard, diatonic keys 62, 74 are separated by a number of keys along central column 44. Each central key 62, 72, 74 is separated from adjacent central keys by a shared surrounding key.

Figure 4A:
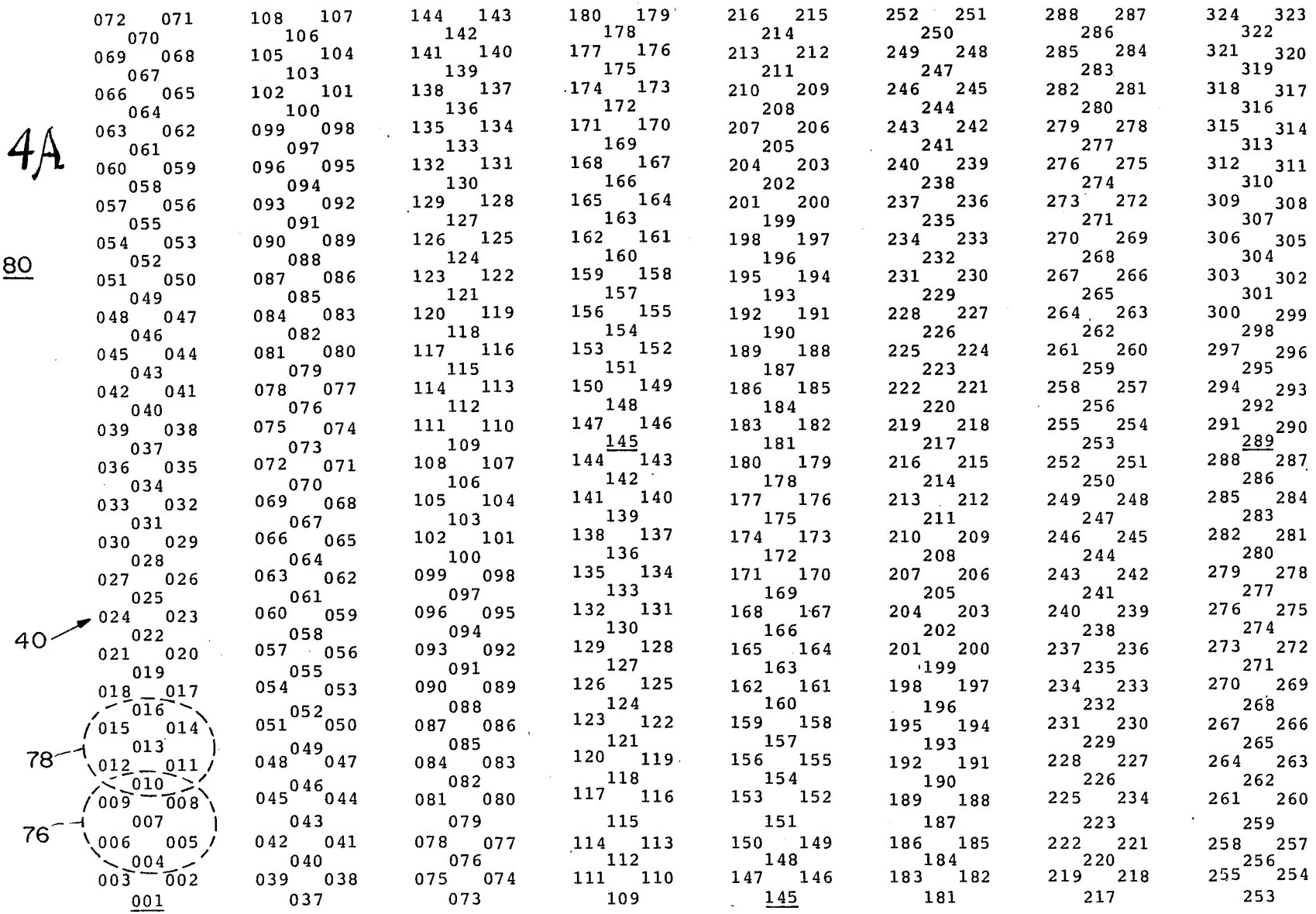
FIG. 4A is a chart of the organization of 576 keys in eight groups according to this invention.
Figure 4B:
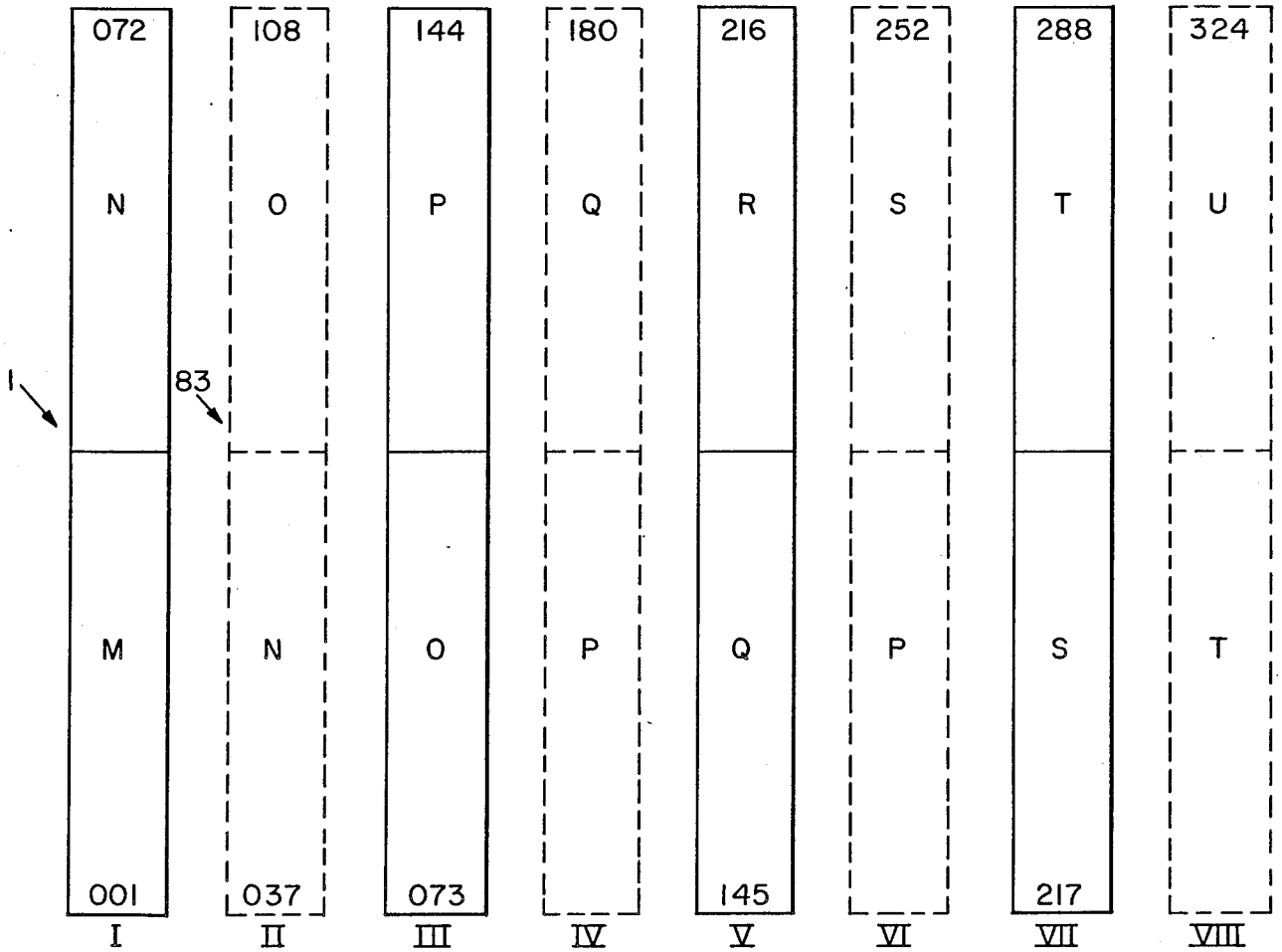
FIG. 4B is a schematic diagram of the relationship among the eight groups of FIG. 4A.
Figure 5:
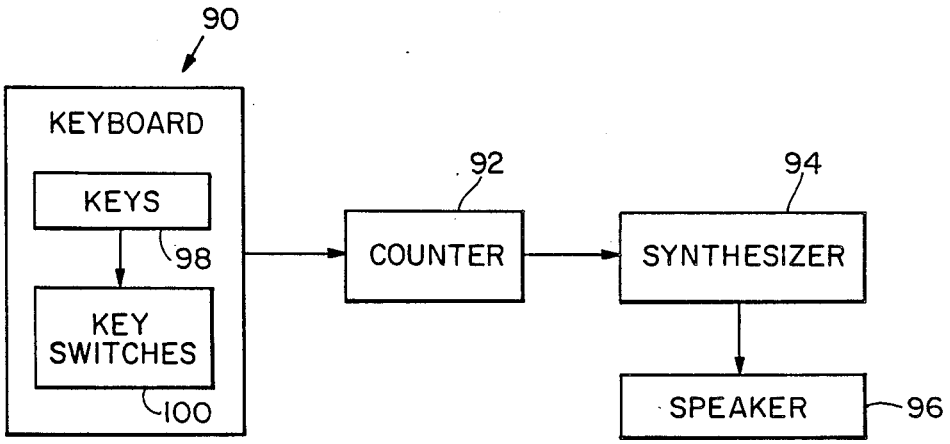
FIG. 5 is a schematic block diagram of a microtonal keyboard system according to this invention for actuating a music synthesizer.

Group 40 is shown as part of keyboard layout 80, FIG. 4A. Key 62, designated as key 001, represents low C, key 145 represents middle C, and key 289 represents high C. Keyboard layout 80 is divided into eight groups, each one octave in length. The relationship among the groups is shown in FIG. 4B revealing that the groups are arranged in two sets, the first set 81 represented by solid lines, the second set 83 represented by dashed lines. First set 81 of groups I, III, V, and VII is divided into successive half octaves M, N, O, P, Q, R, S and T and begins with key 001 and ends with key 288. The second set 83 having groups II, IV, VI, and VIII begins with key 037 of half octave N and ends with key 324 of half octave U. The advantage of this configuration is that duplicate fingerings are provided: four octaves are placed within easy reach of both hands, and half-octaves reaches are readily accomplished with a single hand. For example, if only the first set of module groups were present, it might be difficult to reach from a key in half-octave N to a key in half-octave 0; in this configuration, those two octaves are adjacent to each other at two different locations on the board Keyboard layout 80 can be incorporated into keyboard system 90, FIG. 5, which is connected in turn to microcomputer 92, music synthesizer 94, and speaker 96. In one construction, touch-sensitive keys 98 are associated with key switches 100. In a preferred construction, switches 100 sense the change in electric potential when touched by a finger. Alternatively, switches 100 may be membrane switches, depressable buttons, or optically sensitive switches activated with a light pen. Further, the keys may have a direct mechanical linkage to a sound producing or registering device other than synthesizer 94, such as a pipe organ, xylophone, or electronic music laboratory equipment. The keys themselves may emit a sound, such as when each key is a bell which sounds when struck.

Figure 6:
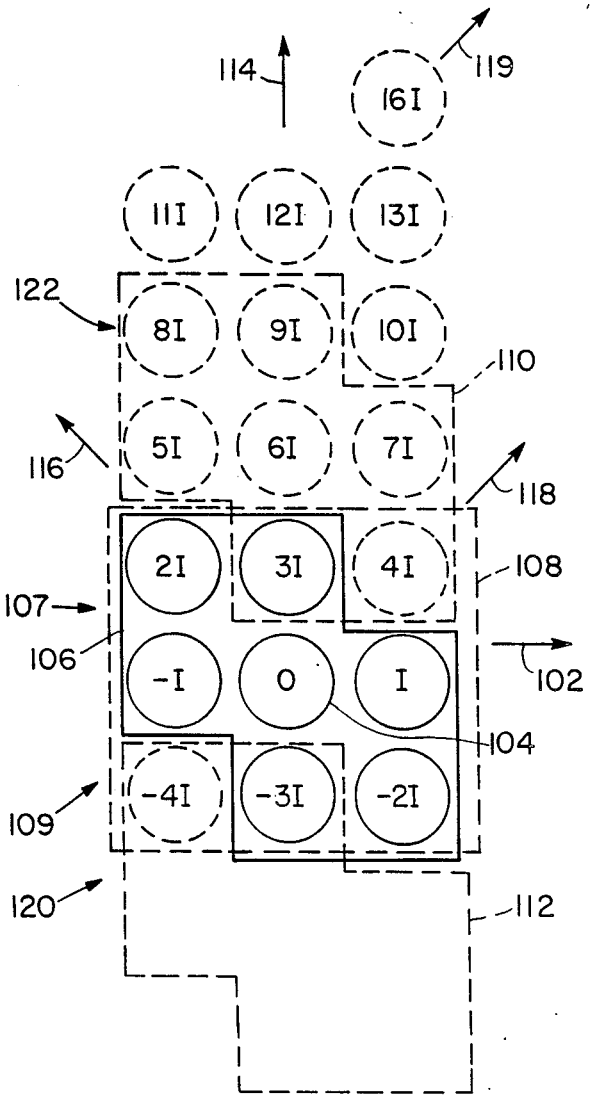
FIG. 6 is a schematic diagram of an alternative module configuration according to this invention.

While microtonal key modules according to this invention are described above as having a central key surrounded by six other keys, this is not a limitation of the invention. By slightly skewing the rows of keys to a direction represented by arrow 102, FIG. 6, which is appropriately normal to the column direction illustrated by arrow 114, central key 104 is placed adjacent to eight surrounding keys. The module including central key 104 can be defined as module 107, represented by solid line 106, which has six surrounding keys, or as module 109, represented by dashed line 108, which has eight surrounding keys. Module 107 shares one key with module 110 and another surrounding key with module 112 while module 109 shares three keys with adjacent modules. Regardless how the module is actually defined, pitches of the keys still proceed in increments of 3I in direction 114 and 2I in direction 116; where I is a twelfth-tone, a twelfth-tone scale is established in direction 102, and directions 114, 116 represent quarter-tone and sixth-tone progressions, respectively. Further, in this construction a third-tone scale is established in the direction indicated by arrows 118, 119, which progress through every fourth row, e.g. rows 120, 122. Moreover, instead of separate groups of modules, a continuous sheet of keys may be established by continuing the keys in the twelfth-tone and sixth- tone directions.

Although specific features of the invention are shown in some drawings and not others, this is for convenience only as each feature may be combined with any or all of the other features in accordance with the invention.

Other embodiments will occur to those skilled in the art and are within the following claims:

What is claimed is:

1. An integral microtonal keyboard system comprising a plurality of microtonal key modules organized into non-overlapping groups of said modules, each group of said modules including a first set of microtonal key modules for duplicating microtones generated by a second set of microtonal key modules located within an adjacent group of said modules, each microtonal key module of said plurality of microtonal key modules including a central key and a plurality of surrounding keys substantially evenly spaced radially from said central key and substantially evenly spaced from each other along a generally circular axis, said central and surrounding keys establishing together a progression of successive microtonal increments.

2. The microtonal keyboard system of claim 1 in which each group defines an octave.

3. The keyboard system of claim 1 in which, for each module there are six surrounding keys clustered about said central key.

4. The keyboard system of claim 1 in which each module shares at least one of its surrounding keys with an additional and similar microtonal key module which continues said progression.

5. The keyboard system of claim 1 in which, for each module said progression of microtonal increments commences at an initial one of said surrounding keys and proceeds among said surrounding keys and said central key until a final one of said surrounding keys different than said initial one of said surrounding keys is reached.

6. The keyboard system of claim 5 in which said final surrounding key is simultaneously said initial one of said surrounding keys of a different one of said plurality of microtonal key modules to provide overlapping microtonal key modules.

7. The keyboard system of claim 1 in which, for each module said successive microtonal increments are equal-tempered.

8. The keyboard system of claim 1 in which, for each module each said microtonal increment is a twelfth-tone.

9. The keyboard system of claim 1 in which, for each module each said microtonal increment is a sixth-tone.

10. A microtonal keyboard system comprising non-overlapping groups of microtonal key modules in which each group is divided into at least two sets of microtonal key modules, at least one of said sets replicating microtones generated by a set of microtonal key modules of an adjacent group, each module of each set including a central key and a plurality of surrounding keys clustered about said central key, said central key and said surrounding keys of each set establishing among each other a progression of successive microtonal increments, and each module sharing at least one of its said surrounding keys with at least one other of said modules, an end of one of said modules establishing among an adjacent module a progression of microtonal increments coinciding with the start of a successive module progression to establish a continuum of said microtonal increments through said modules.

11. The keyboard system of claim 10 in which said central keys are spaced from each other by the same number of microtonal increments.

12. The keyboard system of claim 10 in which each central key is six microtonal increments from the central keys of adjacent said modules.

13. The keyboard system of claim 10 in which each central key represents one of twelve half-tones of an octave.

14. The keyboard system of claim 10 in which said modules extend successively in a first direction, and said central keys are disposed in a central column extending in said first direction.

15. The keyboard system of claim 14 in which each said central key is separated along said central column from an adjacent central key by one of said surrounding keys.

16. The keyboard system of claim 14 in which at least one of said surrounding keys of each said module define a first column on one side of said central column and at least one other of said surrounding keys of each said module define a second column on the other side of said central column.

17. The keyboard system of claim 16 in which each said microtonal increment is a twelfth-tone, and said keys of each said column establish a quarter-tone scale along that column.

18. The keyboard system of claim 16 in which each said microtonal increment is a twelfth-tone, and said central and surrounding keys are aligned in successive rows extending in a second direction transverse to said first direction to establish successive twelfth-zone scales.

19. The keyboard system of claim 10 in which each of said central and surrounding keys includes switch means for registering actuation of each key by an operator.

20. The keyboard system of claim 19 in which said switch means is a touch-sensitive switch manipulated by the operator.

21. The keyboard system of claim 10 in which said successive microtonal increments are equal-tempered.

* * * * *